US006293068B1

(12) United States Patent
Harrington, Jr.

(10) Patent No.: US 6,293,068 B1
(45) Date of Patent: Sep. 25, 2001

(54) FOAM PANEL AND CHANNEL CONCRETE FORM SYSTEM

(76) Inventor: James T. Harrington, Jr., 2620 NW. 111 St., Miami, FL (US) 33167

( * ) Notice: Subject to any disclaimer, the term of this patent is extended or adjusted under 35 U.S.C. 154(b) by 0 days.

(21) Appl. No.: 09/379,249

(22) Filed: Aug. 23, 1999

(51) Int. Cl.[7] ..... E04B 2/30; E04C 2/288

(52) U.S. Cl. ..... 52/426; 52/565; 52/562; 249/47; 249/194; 249/216

(58) Field of Search ..... 52/426, 427, 383, 52/565, 309.12, 309.17, 275; 249/47, 194, 216

(56) References Cited

U.S. PATENT DOCUMENTS

| | | | | |
|---|---|---|---|---|
| 4,936,540 | | 6/1990 | Boeshart . | |
| 5,038,541 | * | 8/1991 | Gibbar, Jr. | 52/426 |
| 5,040,344 | | 8/1991 | Durand . | |
| 5,649,401 | | 7/1997 | Harrington | 52/426 |
| 5,809,726 | | 9/1998 | Spude | 52/426 |
| 5,819,489 | * | 10/1998 | McKinney | 52/426 |
| 5,992,114 | * | 11/1999 | Zelinsky et al. | 52/426 |

* cited by examiner

*Primary Examiner*—Anthony D. Barfield
(74) *Attorney, Agent, or Firm*—Alvin S. Blum

(57) ABSTRACT

A prefabricated wall forming structure for constructing reinforced concrete walls employs insulating foam plastic panels that are interlocked into two parallel concrete impervious walls by connectors having two I beam channels that are spaced apart by tie elements having an arcuate cross section. The tie elements support reinforcing bars. The I beams may have striated outer faces to hold stucco and plaster. The web of at least one of the I beams may have an elongate channel or raceway for wires and pipes. Connectors may be applied vertically and horizontally to seal all edges of the panels and resist the hydraulic forces of the poured concrete. The connectors and panels remain in place after concrete is poured to create an insulated concrete wall. A method of extruding the connectors uses an intermittently opening and moving die passage to create the tie elements and the I beams in one continuous process.

15 Claims, 3 Drawing Sheets

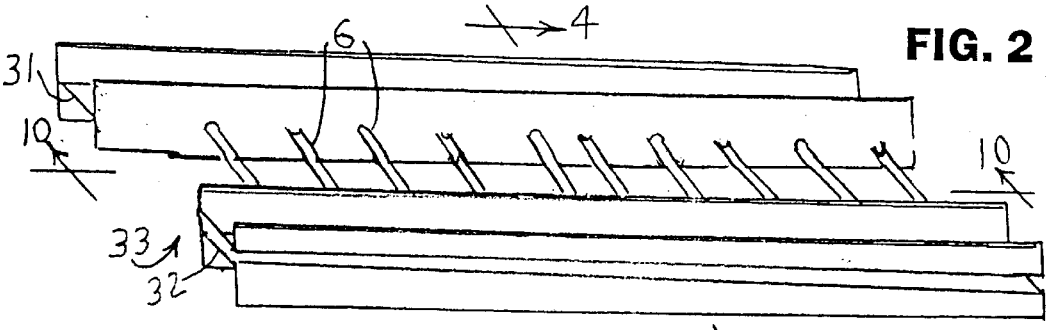
FIG. 2
FIG. 1
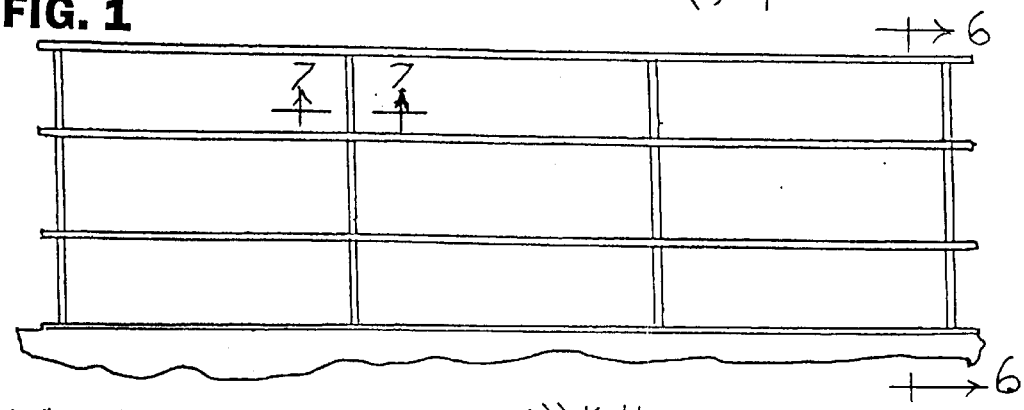
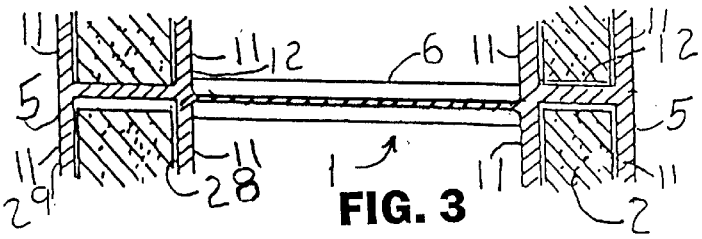
FIG. 3
FIG.4
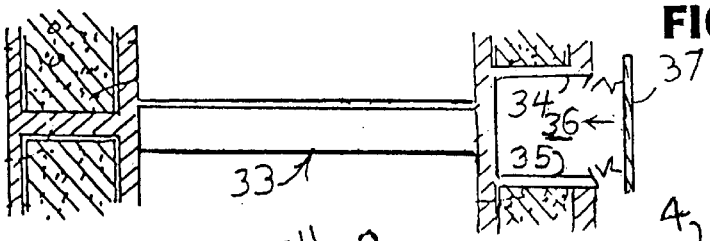
FIG. 5
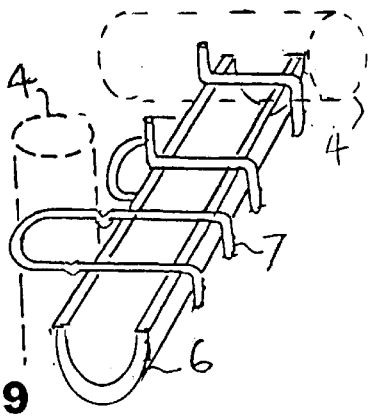
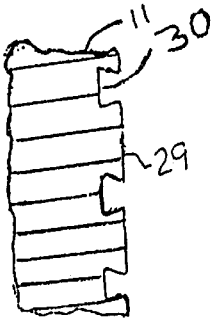
FIG. 8
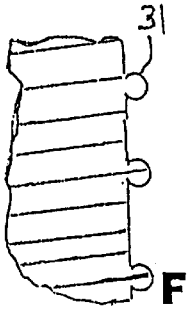
FIG. 9

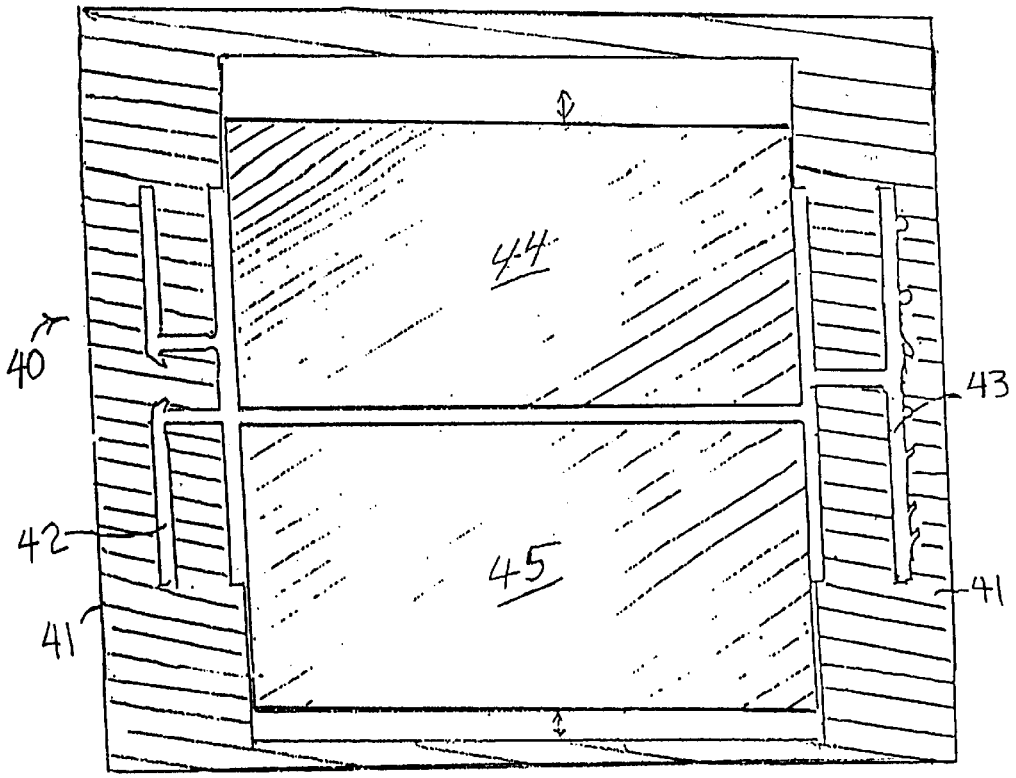
FIG.11
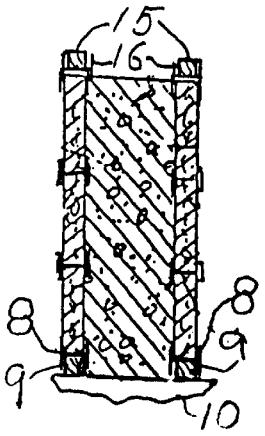
FIG. 6
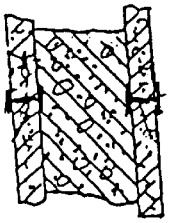
FIG. 7
FIG. 2 A
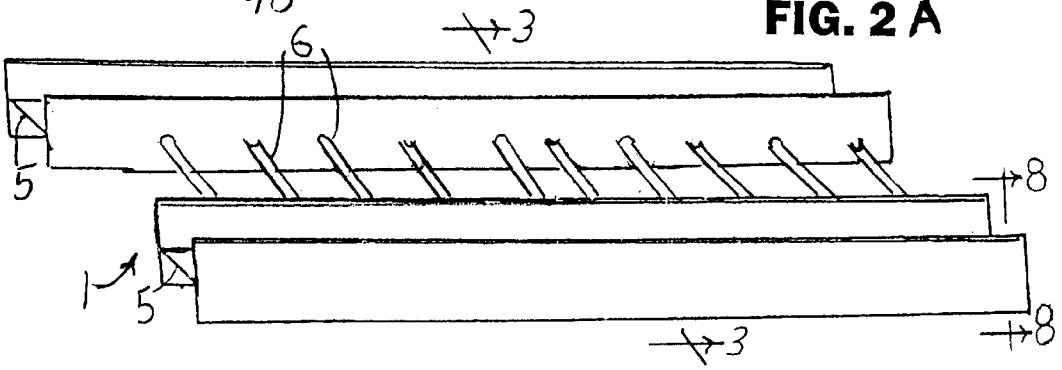

FIG. 2B
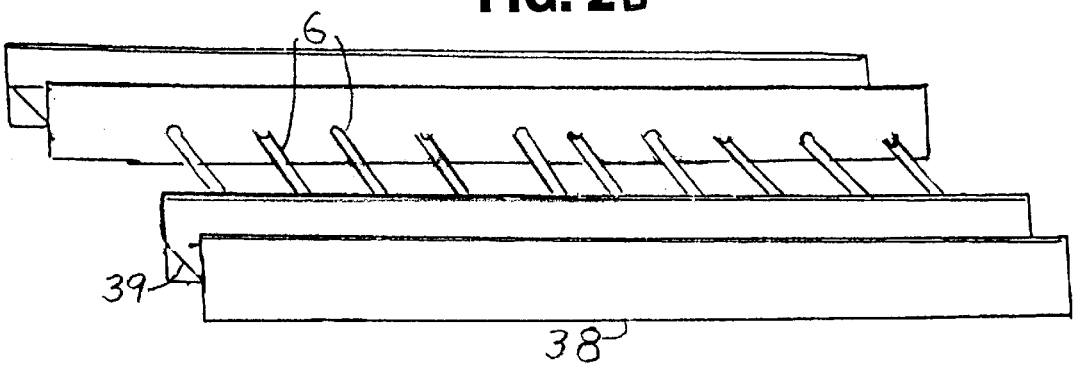
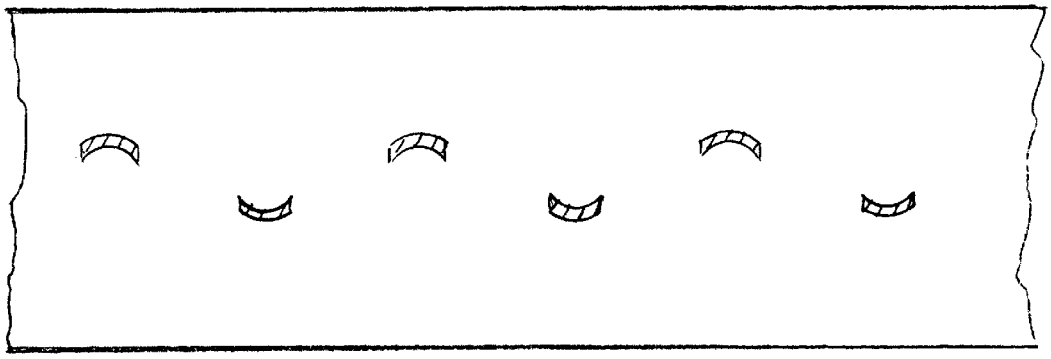
FIG. 10

FOAM PANEL AND CHANNEL CONCRETE FORM SYSTEM

BACKGROUND OF THE INVENTION

This invention relates to prefabricated forming elements for construction of reinforced concrete building walls with foam faces, and methods of wall construction employing those elements.

DESCRIPTION OF THE PRIOR ART

Conventional forming for reinforced concrete walls uses heavy plywood panels clamped and nailed in place with tie rods between parallel panels to prevent their spreading apart from hydraulic force. Reinforcing bars are wired in place and concrete poured into the cavity. The panels are then stripped away. Insulation may be fastened to the concrete and wall finishes such as stucco exterior and gypsum lathe interior applied as desired. Rigid foam panels have been shown to be strong enough to substitute for plywood panel in concrete forms. They have the distinct advantage in that they may remain in place to provide sealed permanent insulation layers.

U.S. Pat. Nos. 5,040,344; and 4,936,540 disclose foam panel concrete forming systems. U.S. Pat. No. 5,809,726 issued Sep. 22, 1998 to Spude teaches vertically oriented I beams with flanges that insert into slots cut in spaced apart vertical foam panels to provide concrete receiving wall forms with foam faces for receiving wall finishes. U.S. Pat. No. 5,649,401 issued Jul. 22, 1997 to Harrington, Jr. teaches a prefabricated wall forming system for reinforced concrete wall construction employing uncut foam panels that are interlocked into two impervious walls by insertion into connectors having two parallel I beam channels that are spaced apart by tie elements. The outer faces of the connectors are not easily adherent to plaster or stucco. Furthermore, no provision is made for insertion of elongate items such as pipes and wires in the finished wall.

SUMMARY OF THE INVENTION

It is accordingly an object of the invention to provide an improved foam panel reinforced concrete forming system that is inexpensive to produce, requires little skill and labor, and produces a superior finished wall, and that requires no special treatment of the foam panels. It is another object that the system hold the entire edges of adjacent panels together so that the integrity of the form assembly is not compromised by unsupported edges. It is yet another object that means be provided for enhanced support of horizontal and vertical reinforcing rods. It is yet another object to provide sturdy exposed surfaces for the enhanced attachment of finish wall surfaces such as gypsum drywall, plaster, and stucco. It is yet another object that the system optionally provide longitudinal channels or raceways within the form walls for installation of elongate elements such as pipes and wires.

The forming system of the invention comprises I beam channels for sealingly receiving and holding in position adjacent horizontal edges of foam panels along their entire edges. A pair of the I beams are held parallel to one another and spaced apart by a plurality of rigid tie elements having a length equal to the thickness of the concrete wall to be poured. The tie elements are arcuate in shape for enhanced rigidity and ease of construction. The tie elements are provided with means for holding reinforcing rods both horizontally and vertically that greatly reduce labor costs and ensure proper construction. The web of at least one of the I beams may be formed of two spaced apart strips to define therebetween an elongate channel or raceway for installation of wires and pipes within the wall. The raceway may be optionally provided with a removable closure or a sealed outer face continuous with the balance of the outer flange of the I beam.

A method of construction of the connector by extrusion involves providing an extrusion die in which the tie elements are formed during the extrusion process by intermittent opening and closing of a passage connecting the I beam portions of the die and moving the position of that passage up and down during the extrusion process to create a plurality of arcuate elements for enhanced rigidity.

BRIEF DESCRIPTION OF THE DRAWINGS

FIG. 1 is a side elevation view of a reinforced concrete wall produced by the wall forming structure of the invention.

FIG. 2 is a perspective view of a connector of the invention.

FIG. 2A is a perspective view of another connector of the invention.

FIG. 2B is a perspective view of another connector of the invention.

FIG. 3 is a sectional view taken through line 3—3 of FIG. 2A.

FIG. 4 is a sectional view taken through line 4—4 of FIG. 2.

FIG. 5 is a perspective view of the connector of FIG. 2 with reinforcing rod supports connected and rods shown in phantom.

FIG. 6 is a sectional view taken on line 6—6 of FIG. 1.

FIG. 7 is a sectional view taken on line 7—7 of FIG. 1.

FIG. 8 is an enlarged fragmentary sectional view taken through line 8—8 of FIG. 2A.

FIG. 9 is an enlarged fragmentary sectional view as in FIG. 8 of another embodiment of the invention.

FIG. 10 is a sectional view taken on line 10—10 of FIG. 2.

FIG. 11 is a diagrammatic sectional view of an extrusion die for forming the connector of FIG. 2.

DETAILED DESCRIPTION OF PREFERRED EMBODIMENTS

Referring now first to FIGS. 1–10, the concrete forming system of the invention comprises a set of lightweight, thermally insulating panels 2, such as rigid foam plastic well known in the art, as exemplified by polystyrene and polyurethane. These may be 1×8 feet and 2 inches thick. The panels are held in place by connectors 1 to form a pair of parallel walls 26,27 spaced apart to define therebetween a space 28, which is intended to be filled with concrete 3 and reinforcing bars 25 generally of steel.

The connector 1 comprises a pair of I beams 5 held in spaced apart relation by a plurality of tie elements 6 that have a generally arcuate cross section for enhanced rigidity. Each I beam 5 has a pair of parallel opposed flanges 11 spaced apart by a web 12 such that the horizontal edges 14 of the panels will fit snugly therein to form a concrete impervious seal of the inner surface 28 of the flange to an upper and lower panel as well as holding the panels in vertical alignment. The outer surface 29 of the flange may be provided with longitudinal striations 30 with undercuts created by recesses in the face 29 of flange 11 of fig.8 or by striations created by projections 31 of FIG. 9 to provide means for securely attaching wall surfacing materials such as stucco, plaster, adhesives and the like. Vertical connectors 13 may also be employed to seal and join the vertical edges 15 of the panels. The vertical connectors may extend the full height of the wall and may be employed with braces and shoring when adjusting the verticality of the forms prior to pouring. The vertical connectors may have the structure of the horizontal connectors, either with or without raceways, as desired.

As shown in FIG. 6, the I beams 8 of the lowermost connectors may first be secured to 2×2 timbers 9 that are fastened to the foundation 10 to establish the correct position of the wall. The uppermost connector may also receive timbers 15 in I beams 16. These long upper timbers provide convenient nailing sites for shoring, top plates, roofing and the like.

Because substantially all of the edges of the panels are sealed and joined together by the vertical and horizontal I beams, the hydraulic forces of the fluid concrete are taken up and held in place by the connectors. The entire edges and the full thickness of the panel resist the hydraulic forces sufficiently that a full height pour can be safely made.

The horizontal and vertical connectors may also be used to frame doorways, windows, and other wall openings prior to pouring the concrete. Timbers may be inserted into the I beams on the inner aspect of the opening to support framing lumber, for example.

As best seen in FIG. 5, bent wire supports 7 may be snapped onto the tie elements 6 so as to securely hold both vertical and horizontal reinforcing rods or bars during the pouring. The labor intensive placing and wire tying of bars is thereby eliminated.

Referring now to FIGS. 2 and 4, another embodiment of the connector 33 of the invention is shown, in which one of the webs 31 is as shown supra, and the other web 32 is formed by an upper strip 34 and a lower strip 35 that are spaced apart to define therebetween an elongate channel 36 that is useful as a raceway for containing long elements such as pipes and wires within the finished wall. A removable cover or closure 37 is provided that snaps in place to provide a substantially planar face with the outer flange. Fig.2B shows another embodiment of the connector 38 with a raceway 39 having a non-removable cover.

Referring now to FIG. 11, an extrusion die 40 is shown that may be suitable for the extrusion of the connector of FIGS. 2 and 4 from a thermoplastic material such as a polyolefin or a polyvinyl chloride. The method will provide the connector in finished form with negligible labor costs. The die has fixed side members 41 to form the I beams in cavities 42, 43. Upper movable element 44 and lower movable element 45 move up and down relative to the members 41, with sliding seals preventing passage of plastic therebetween. During most of the extrusion run, elements 44 and 45 are pressed tightly together to prevent any plastic forming between the I beams. Intermittently, the elements separate enough to pass plastic to form the tie element. Elements 44, 45 move up and down in synchronism to cause the tie element being extruded to have an arcuate cross section for enhanced rigidity.

The above disclosed invention has a number of particular features which should preferably be employed in combination, although each is useful separately without departure from the scope of the invention. While I have shown and described the preferred embodiments of my invention, It will be understood that the invention may be embodied otherwise than herein specifically illustrated or described, and that certain changes in form and arrangement of parts and the specific manner of practicing the invention may be made within the underlying idea or principles of the invention.

What is claimed is:

1. A concrete wall forming structure comprising:

a) a first concrete impervious form wall and a second concrete impervious form wall substantially parallel to one another and spaced apart from one another to define therebetween a space arranged to receive and hold reinforcing rods and poured concrete, each form wall comprised of a plurality of rigid foam panels, each panel having a length, a height, and a width dimension, each panel also having a top and a bottom planar surface extending in the length and width dimension and separated from one another by the height dimension, each panel having broad opposed front and back opposed planar faces, and each panel positioned in one of the form walls with its height dimension generally vertically and its width dimension generally horizontally, the foam panels disposed on top of one another and in side to side relation to thereby provide a form wall, the panels of the first form wall being spaced apart from, and unattached to, the panels of the second form wall; and b) a plurality of horizontal connector means for interlocking the bottom surface of an upper panel with the top surface of a lower panel upon which it is disposed in a concrete impervious connection, each horizontal connector means comprising:

i) first and second elongate horizontal I beam channels for securing the panels of the first and second form walls respectively, each I beam channel having a web with upper and lower faces adapted to engage the bottom and top surfaces respectively of the upper and lower panels respectively, each I beam channel having flanges with inner and outer surfaces, the inner surfaces of the flanges adapted to engage the front and back faces of the panels adjacent the top and bottom panel surfaces in concrete impervious engagement, at least one of the outer surfaces of at least one of the flanges provided with longitudinal striation means with undercuts parallel to the web for securing materials thereto, at least one of the webs comprising an upper strip having the upper face and a lower strip having the lower face, the upper and lower strips being spaced apart to define therebetween an elongate channel that may be employed as a raceway for the containment of elongate items; and ii) a plurality of spaced apart tie elements attached to, and extending between, the first and second I beam channels, the tie elements holding the I beam channels apart at a predetermined distance to thereby define the space to be filled by poured concrete and to resist relative movement between the first and second form walls, the tie elements being substantially arcuate in cross section.

2. The structure according to claim 1, in which the elongate channel is provided with a removable outer closure.

3. The structure according to claim 2, further comprising reinforcing rod supports connected to the tie elements for securely supporting both horizontal and vertical reinforcing rods within the space between the first and second form walls.

4. The structure according to claim 1, further comprising reinforcing rod supports connected to the space between the first and second form walls.

5. The structure according to claim 4, further comprising:

a plurality of vertical connector means for interlocking the side surfaces of side by side adjacent panels together in a concrete impervious connection, each vertical connector means comprising an elongate vertical I beam channel with opposed side faces adapted to engage the side surfaces of adjacent panels, and having flanges adapted to snugly engage the front and back faces in concrete impervious engagement.

6. The structure according to claim 1, further comprising:

a plurality of vertical connector means for interlocking the side surfaces of side by side adjacent panels together in a concrete impervious connection, each vertical connector means comprising an elongate vertical I beam channel with opposed side faces adapted to engage the side surfaces of adjacent panels, and having flanges adapted to snugly engage the front and back faces of the adjacent panels in concrete impervious engagement.

7. The structure according to claim 6, in which the vertical connector means comprises two of the elongate vertical I beam channels joined by a plurality of tie elements holding the channels in spaced apart parallel relation.

8. A concrete wall forming structure comprising:

a) a first concrete impervious form wall and a second concrete impervious form wall substantially parallel to one another and spaced apart from one another to define therebetween a space arranged to receive and hold reinforcing rods and poured concrete, each form wall comprised of a plurality of rigid foam panels, each panel having a length, a height, and a width dimension, each panel also having a top and a bottom planar surface extending in the length and width dimension and separated from one another by the height dimension, each panel having broad opposed front and back opposed planar faces, and each panel positioned in one of the form walls with its height dimension generally vertically and its width dimension generally horizontally, the foam panels disposed on top of one another and in side to side relation to thereby provide a form wall, the panels of the first form wall being spaced apart from, and unattached to, the panels of the second form wall; and b) a plurality of horizontal connector means for interlocking the bottom surface of an upper panel with the top surface of a lower panel upon which it is disposed in a concrete impervious connection, each horizontal connector means comprising:

i) first and second elongate horizontal I beam channels for securing the panels of the first and second form walls respectively, each I beam channel having a web with upper and lower faces adapted to engage the bottom and top surfaces respectively of the upper and lower panels respectively, each I beam channel having flanges with inner and outer surfaces, the inner surfaces of the flanges adapted to engage the front and back faces of the panels adjacent the top and bottom panel surfaces in concrete impervious engagement, at least one of the outer surfaces of at least one of the flanges provided with longitudinal striation means with undercuts parallel to the web for securing materials thereto; and ii) a plurality of spaced apart tie elements attached to, and extending between, the first and second I beam channels, the tie elements holding the I beam channels apart at a predetermined distance to thereby define the space to be filled by poured concrete and to resist relative movement between the first and second form walls, the tie elements being substantially arcuate in cross section.

9. The structure according to claim 8, further comprising reinforcing rod supports connected to the tie elements for securely supporting both horizontal and vertical reinforcing rods within the space between the first and second form walls.

10. In a concrete wall forming structure having;

a first concrete impervious form wall and a second concrete impervious form wall substantially parallel to one another and spaced apart from one another to define therebetween a space arranged to receive and hold reinforcing rods and poured concrete, each form wall comprised of a plurality of rigid foam panels, each panel having a length, a height, and a width dimension, each panel also having a top and a bottom planar surface extending in the length and width dimension and separated from one another by the height dimension, each panel having broad opposed front and back opposed planar faces, and each panel positioned in one of the form walls with its height dimension generally vertically and its width dimension generally horizontally, the foam panels disposed on top of one another and in side to side relation to thereby provide a form wall, the panels of the first form wall being spaced apart from, and unattached to, the panels of the second form wall, the improvement comprising:

a plurality of horizontal connector means for interlocking the bottom surface of an upper panel with the top surface of a lower panel upon which it is disposed in a concrete impervious connection, each horizontal connector means comprising:

i) first and second elongate horizontal I beam channels for securing the panels of the first and second form walls respectively, each I beam channel having a web with upper and lower faces adapted to engage the bottom and top surfaces respectively of the upper and lower panels respectively, each I beam channel having flanges with inner and outer surfaces, the inner surfaces of the flanges adapted to engage the front and back faces of the panels adjacent the top and bottom panel surfaces in concrete impervious engagement, at least one of the outer surfaces of at least one of the flanges provided with longitudinal striation means with undercuts parallel to the web for securing materials thereto; and ii) a plurality of spaced apart tie elements attached to, and extending between, the first and second I beam channels, the tie elements holding the I beam channels apart at a predetermined distance to thereby define the space to be filled by poured concrete and to resist relative movement between the first and second form walls, the tie elements being substantially arcuate in cross section.

11. The connector means according to claim 10, further comprising reinforcing rod supports connected to the tie elements for securely supporting both horizontal and vertical reinforcing rods within the space between the first and second form walls.

12. The connector means according to claim 10, in which at least one of the webs comprises an upper strip having an upper face and a lower strip having a lower face, the upper and lower strips being spaced apart to define therebetween an elongate channel that may be employed as a raceway for containment of elongate elements.

13. The connector according to claim 12 in which the channel is provided with a removable cover.

14. A concrete wall forming structure comprising:

a) a first concrete impervious form wall and a second concrete impervious form wall substantially parallel to one another and spaced apart from one another to define therebetween a space arranged to receive and hold reinforcing rods and poured concrete, each form wall comprised of a plurality of rigid foam panels, each panel having a length, a height, and a width dimension, each panel also having a top and a bottom planar surface extending in the length and width dimension and separated from one another by the height dimension, each panel having broad opposed front and back opposed planar faces, and each panel positioned in one of the form walls with its height dimension generally vertically and its width dimension generally horizontally, the foam panels disposed on top of one another and in side to side relation to thereby provide a form wall, the panels of the first form wall being spaced apart from, and unattached to, the panels of the second form wall; and b) a plurality of horizontal connector means for interlocking the bottom surface of an upper panel with the top surface of a lower panel upon which it is disposed in a concrete impervious connection, each horizontal connector means comprising:

i) first and second elongate horizontal I beam channels for securing the panels of the first and second form walls respectively, each I beam channel having a web with upper and lower faces adapted to engage the bottom and top surfaces respectively of the upper and lower panels respectively, each I beam channel having flanges with inner and outer surfaces, the inner surfaces of the flanges adapted to engage the front and back faces of the panels adjacent the top and bottom panel surfaces in concrete impervious engagement, at least one of the webs comprising an upper strip having the upper face and a lower strip having the lower face, the upper and lower strips being spaced apart to define therebetween an elongate channel that may be employed as a raceway for the containment of elongate items; and ii) a plurality of spaced apart tie elements attached to, and extending between, the first and second I beam channels, the tie elements holding the I beam channels apart at a predetermined distance to thereby define the space to be filled by poured concrete and to resist relative movement between the first and second form walls.

15. The structure according to claim 14 in which the tie elements are arcuate in cross section.

* * * * *